United States Patent [19]

Parkinson et al.

[11] 4,365,834

[45] Dec. 28, 1982

[54] LIFTING TACKLE

[75] Inventors: William B. Parkinson; Trevor Lamprell, both of Atherton, England

[73] Assignee: Lifting Gear Hire Limited, Manchester, England

[21] Appl. No.: 209,689

[22] Filed: Nov. 24, 1980

[51] Int. Cl.[3] ..... B66D 3/00

[52] U.S. Cl. ..... 294/85; 294/103 R

[58] Field of Search ..... 294/103 R, 85, 116; 24/241; 248/317, 323, 327, 72, 17, 58, 59, 62, 228, 229

[56] References Cited

U.S. PATENT DOCUMENTS 154,674 9/1874 Howland ..... 294/85

2,877,974 3/1959 Estes ..... 294/85

*Primary Examiner*—James B. Marbert

*Attorney, Agent, or Firm*—LeBlanc, Nolan, Shur & Nies

[57] ABSTRACT

Lifting tackle comprises a hook sheave suspended from a pulley block sheave supported between a pair of parallel arms, the free ends of which are bent to form one member of a pair of gripping jaws the other member being of L shaped pivoted between the two parallel arms.

The L shape member of the jaws engages the upper surface of a flange of a girder or beam and the weight of the hook sheave and load bring the jaw integral with the parallel arms into engagement with the under surface of the flange so that the flange is gripped firmly between the jaws.

This lifting tackle may be attached to the upper or lower flange of the girder or beam and will raise a load into substantial engagement with the underside of the girder or beam.

1 Claim, 1 Drawing Figure

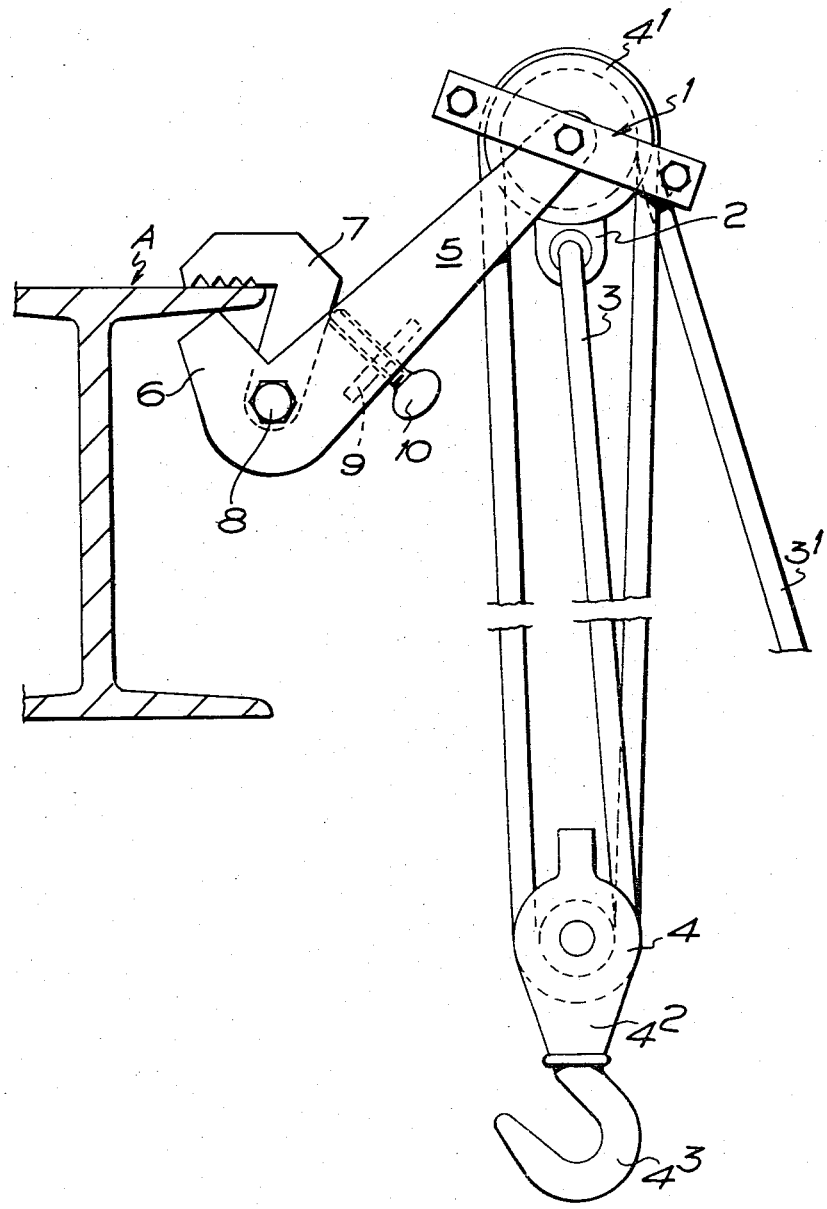
4¹
1
2
A
7
5
3
6
9
10
8
3¹
4
4²
4³

LIFTING TACKLE

This invention relates to improvements in lifting tackle.

A method for raising a load into contact with the underside of an I section girder or beam has been proposed, comprising mounting notched brackets in pairs on the upper flange of the I girder, passing a cord or chain over a pair of pulleys in each bracket of the pair with one end of the cord or chain depending from each bracket, affixing the load to one depending end of the cord or chain and raising the load into contact with the lower flange of the I girder by applying tension to the other end of the cord or chain.

It has been found however that where a girder or beam forms a support for a ceiling or floor a bracket cannot be affixed to the upper flange of the girder or beam and the object of the present invention is to provide a lifting tackle for attachment to the upper or lower flange of the girder or beam which will lift a load into substantial engagements with the underside of the girder or beam.

According to the invention the tackle comprises a hook sheave suspended from a pulley block sheave supported between a pair of parallel arms, the free ends of the arms being bent substantially at right angles to form one member of a pair of gripping jaws, the other member being of L shape pivoted on a spindle between the two parallel arms with the second member of the jaws engaging the upper surface of a flange of a girder or beam, the weight of the hook sheave and load depending from the block bringing the jaw integral with the parallel arms into engagement with the under surface of the flange to grip the flange between the lower and upper jaws.

The invention will be described with reference to the accompanying drawings showing a side view of the tackle mounted on the upper flange of an I girder.

A pulley block sheave 1 employing 2X1 sheave or 2X2 sheave 2 is provided to give a mechanical advantage to reduce the pulling effort.

One end of the lifting rope or chain 3 is attached to the sheave 2 and is threaded in known manner under the pulley 4 on a hook sheave $4^2$ back over a pulley $4^1$. A second pulley 4 may be provided on the hook sheave and a second pulley $4^1$ on the sheave 2, the free end $3^1$ of the rope or chain being accessible for the application of tension for raising a load on a swivel hook $4^3$.

The pulley $4^1$ is pivoted between a pair of parallel arms 5 the free ends of which are bent substantially at right angles to form one jaw member 6 of a pair of gripping jaws, the other member in the form of an L shaped jaw 7 is mounted between the parallel arms 6 on a spindle 8 passing through the arms.

In use the jaw 6 integral with the parallel arms 5 is arranged below the underside of the flange of the I girder A with the L shaped jaw 7 on the upper surface of the flange.

The weight of the sheave 2 and the load suspended therefrom cause the two jaws 6,7 to tighten and grip the flange and the parallel arms of the tackle extending upwards from the flange allow the load to be lifted substantially into contact with the underside of the girder A or beam. The surfaces of the jaw 7 are serrated or roughened to increase their grip on the flange, and may be hardened to reduce wear.

A support arm 9 may be welded between the two parallel arms 5 with a bolt 10 screwed therethrough to form a stop for the pivoted jaw 7 and which can be tightened up to engage the back of the jaw when positioned on the flange.

The thicker the flange on the girder or beam the nearer the parallel arms approach the vertical and the nearer the load is lifted to the underside of the girder or beam.

The tackle may be affixed also to channel, tee and angle sections.

The rope pulley blocks may incorporate a known locking device to sustain the load in the event of the operator releasing the pull on the rope.

Where it is necessary to employ a pulley block to raise a load too heavy for the present tackle the pulley block may be raised by the tackle and the suspension hook of the pulley block being then transferred to a clamp on the girder in known manner.

What we claim is:

1. A lifting tackle comprising a pulley block sheave, a hook sheave suspended therefrom, a pair of parallel arms supporting the pulley block sheave, the free ends of the arms being bent at right angles to form one member of a pair of gripping jaws, a member of L shape forming the second jaw of the pair, a spindle extending between the arms on which the L shaped jaw is pivoted to engage the upper surface of a flange of a girder, a support arm affixed to the parallel arms with a bolt screwed therethrough to form a stop for the L shaped jaw before or after attachment to the flange of the girder, the weight of the hook sheave and load depending from the block bringing the jaw integral with the arms into engagement with the opposite surface of the flange to grip the flange between the pair of jaws.

* * * * *